US007743921B2

(12) United States Patent
Hubbs et al.

(10) Patent No.: US 7,743,921 B2
(45) **Date of Patent: *Jun. 29, 2010**

(54) PRODUCT DISPLAY CARTON

(75) Inventors: William Hubbs, Barrington, IL (US); Christopher Galardi, Gurnee, IL (US); James Trappani, Fort Lauderdale, FL (US)

(73) Assignee: Walgreen Co., Deerfield, IL (US)

( * ) Notice: Subject to any disclaimer, the term of this patent is extended or adjusted under 35 U.S.C. 154(b) by 89 days.

This patent is subject to a terminal disclaimer.

(21) Appl. No.: 11/411,408

(22) Filed: Apr. 26, 2006

(65) Prior Publication Data

US 2006/0191818 A1 Aug. 31, 2006

Related U.S. Application Data

(63) Continuation of application No. 10/099,423, filed on Mar. 15, 2002, now Pat. No. 7,213,707.

(60) Provisional application No. 60/339,433, filed on Dec. 11, 2001.

(51) Int. Cl.
*B65D 85/20* (2006.01)

(52) U.S. Cl. ..... 206/443; 206/575; 206/391; 206/775; 206/225; 220/8; 220/4.21

(58) Field of Classification Search ..... 206/772, 206/769, 774, 767, 736, 443, 446, 575, 225, 206/391, 775, 781, 554; 229/915.1, 915, 229/939, 117.21, 125.21, 125.23, 87.19, 229/923, 132, 23 BT, 129, 125.125, 125.13; 220/644, 645, 8, 4.21
See application file for complete search history.

(56) References Cited

U.S. PATENT DOCUMENTS

| | | | |
|---|---|---|---|
| 476,765 | A | 6/1892 | Knapp |
| 1,128,052 | A | 2/1915 | Roy |
| 2,001,140 | A | 5/1935 | Jordan |
| 2,761,610 | A | 9/1956 | Welshenbach |
| 3,343,659 | A | 9/1967 | Marondel |
| 3,756,499 | A | 9/1973 | Giebel et al. |
| 3,982,690 | A | 9/1976 | Krizan et al. |
| 4,217,984 | A | 8/1980 | Magnuson |
| 4,363,405 | A | 12/1982 | Christie |
| 4,444,313 | A | 4/1984 | Tyson |
| 4,638,745 | A | 1/1987 | Sheffer |

(Continued)

*Primary Examiner*—Jila M Mohandesi
(74) *Attorney, Agent, or Firm*—Francis C. Kowalik; Randall G. Rueth; Marshall, Gerstein & Borun

(57) ABSTRACT

A product shipping and display carton includes a display box and a shipping sleeve. The display box has a removable panel portion below a top rail defining a product viewing window in the display box. The top rail positioned to hold elongated, tubular shaped product within the display box. The product viewing window having a length that is generally smaller than a length of elongated, tubular shaped product to be contained within the display box. The top rail adapted to hold elongated, tubular shaped product within the display box and to allow a customer to remove elongated, tubular shaped product from the display box by displacing part of the elongated, tubular shaped product outwardly through the product viewing window, and displacing the elongated, tubular shaped product in a second direction that is angled to a face of the product-restraining rail until the elongated, tubular shaped product clears the product-restraining rail.

25 Claims, 3 Drawing Sheets

U.S. PATENT DOCUMENTS

| | | | |
|---|---|---|---|
| 5,167,324 | A | 12/1992 | Miller |
| 5,417,342 | A | 5/1995 | Hutchison |
| 5,474,171 | A | 12/1995 | Niesen et al. |
| 6,123,197 | A | 9/2000 | Marquez et al. |
| 6,135,288 | A | 10/2000 | Kim |
| 6,135,289 | A | 10/2000 | Miller |
| 6,371,365 | B1 | 4/2002 | Doucette et al. |
| 2001/0040111 | A1 | 11/2001 | Spradlin et al. |
| 2003/0106835 | A1 | 6/2003 | Hubbs et al. |

PRODUCT DISPLAY CARTON

CROSS-REFERENCE TO RELATED APPLICATIONS

This application is a continuation of U.S. application Ser. No. 10/099,423 filed Mar. 15, 2002 now U.S. Pat. No. 7,213,707, which claims the benefit of U.S. provisional patent application Ser. No. 60/339,433 filed Dec. 11, 2001, the disclosures of which are incorporated herein by reference in their entirety for all purposes.

FIELD OF THE INVENTION

The present disclosure is generally directed to product cartons and, more particularly, to a carton that serves to display a product.

BACKGROUND OF THE INVENTION

For many products, a carton is used to ship them from the point of manufacture to the destination at which they will be sold. This is especially true of many smaller consumer goods which are suitable for shipping in a relatively large quantity within a single carton. Typically, when the carton arrives at the sales destination, the products are removed from the carton and placed on a shelf for selection and purchase by a consumer.

As is known, there are a number of problems that are inherent in the shipping of products in this manner. First, there is the problem of in-store labor that is required to remove the product from the carton and place the products on a shelf. This is obviously a tedious and time-consuming process which must be repeated as the product is depleted from the store shelf. Second, the carton in which the product is shipped has no other function than transporting the products to the store. This means that there is considerable waste inherent in having to dispose of the carton while utilizing it for only a single function. Third, the placement of the products on a store shelf requires store personnel to print out and apply signage at the product display area. This adds to the overall cost of operation in a business that is notorious for slim profit margins. For all of these reasons, there has been a need for combining the shipment and display of products in a single carton.

DETAILED DESCRIPTION OF THE VARIOUS EMBODIMENTS

Figure 1:
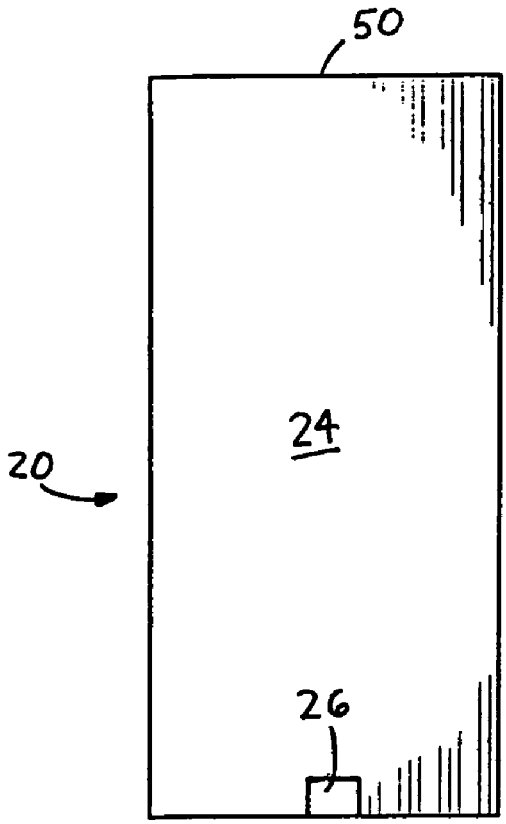
FIG. 1 is a front elevational view of a product shipping and display carton in accordance with the present invention.
Figure 2:
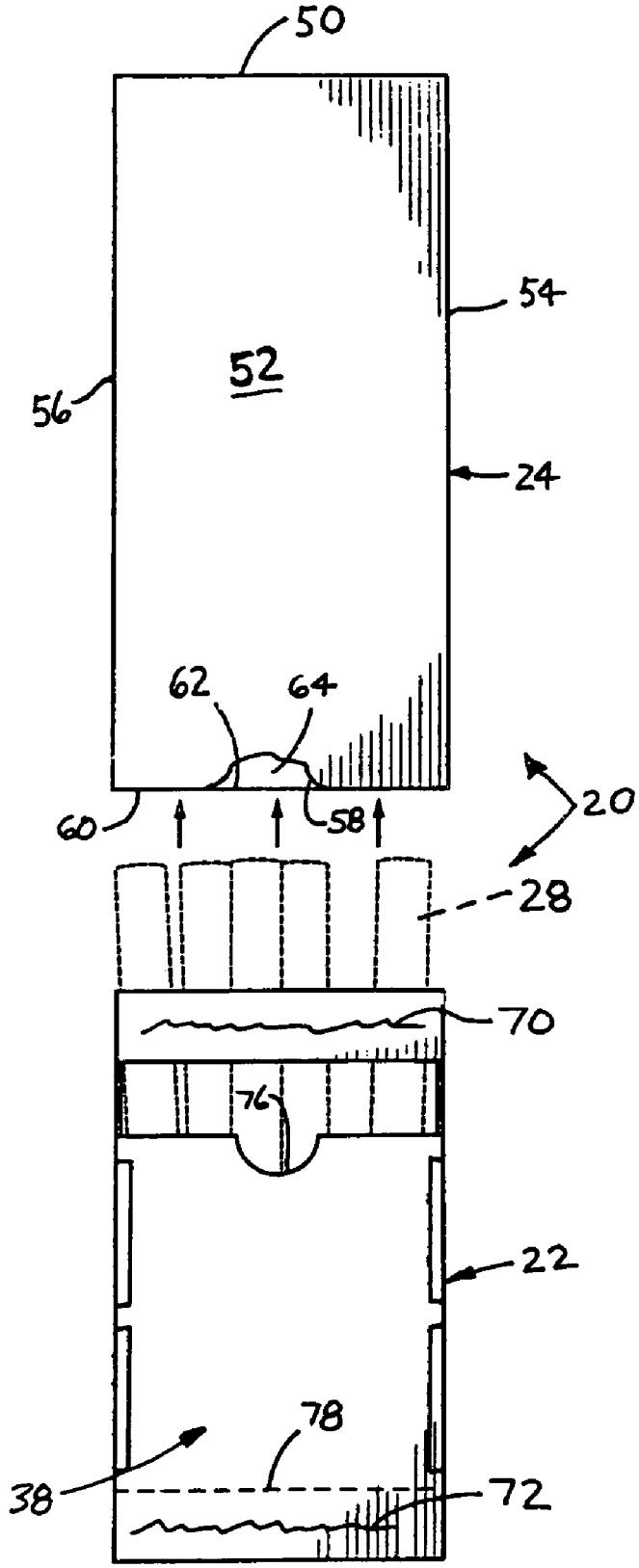
FIG. 2 is a view similar to FIG. 1 but with the shipping sleeve being telescopically removed from the display box.

In the illustrations given, and with reference first to FIGS. 1 and 2, the reference numeral 20 designates generally a product shipping and display carton in accordance with the present invention. The product shipping and display carton 20 includes a display box 22, a shipping sleeve 24, and a removable fastener 26 which may take the form of shipping carton tape. While the carton 20 is useful for shipping and displaying a number of products, it will be described in connection with only a single such product, i.e., elongated holiday gift wrap tubes 28.

Referring now to FIGS. 3-7, it will be seen that the display box 22 is defined by a bottom panel 30, and a plurality of upwardly extending wall panels together forming a carrying and supporting enclosure 32 for the elongated holiday gift wrap tubes 28. The display box 22 includes an open top 34 having a generally rectangular configuration defined by a top wall panel edge 36 disposed opposite the bottom panel 30. The plurality of upwardly extending wall panels includes front and rear wall panels 38 and 40 and a pair of substantially identical side wall panels 42 and 44 and the front wall panel 38 has a removable panel portion 46 below the top wall panel edge 36 defining the open top 34 to form a viewing window 48 (see FIG. 10).

Figure 3:
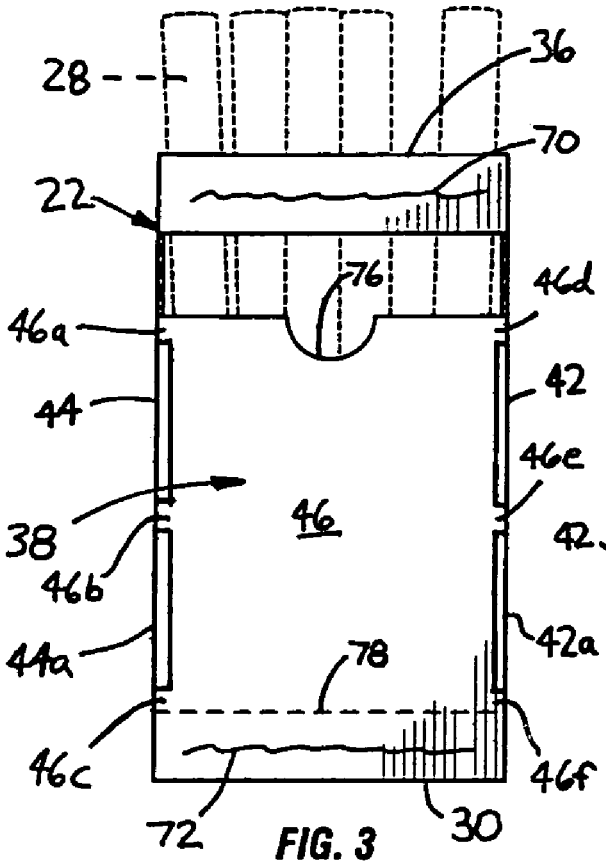
FIG. 3 is a front elevational view of the product shipping and display carton after removal of the shipping sleeve.
Figure 4:
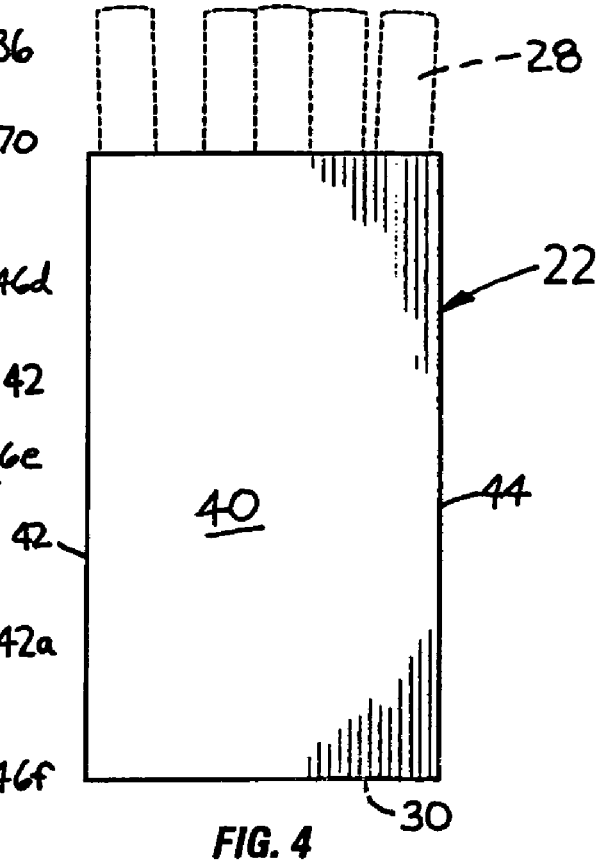
FIG. 4 is a rear elevational view of the product shipping and display carton of FIG. 3.
Figure 5:
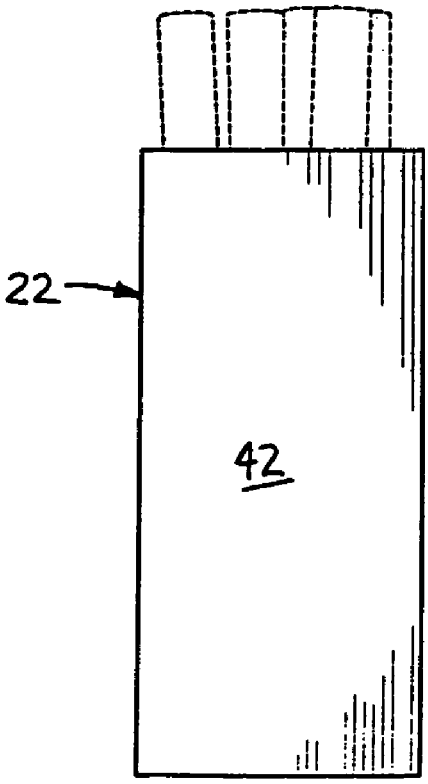
FIG. 5 is a side elevational view of the product shipping and display carton of FIG. 3.
Figure 6:
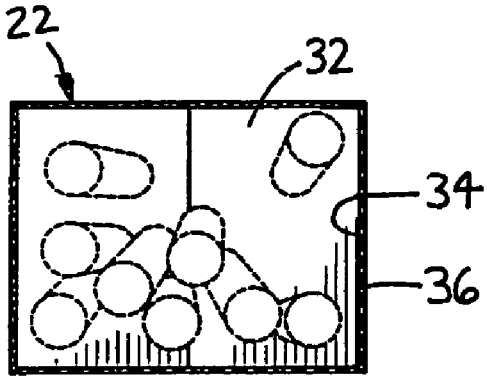
FIG. 6 is a top plan view of the product shipping and display carton of FIG. 3.
Figure 7:
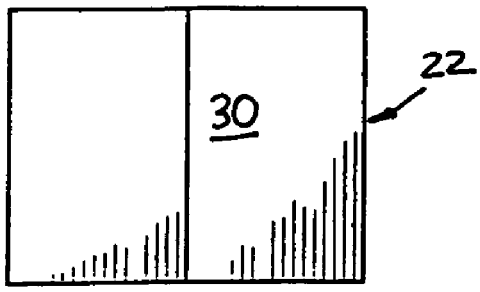
FIG. 7 is a bottom plan view of the product shipping and display carton of FIG. 3.
Figure 8:
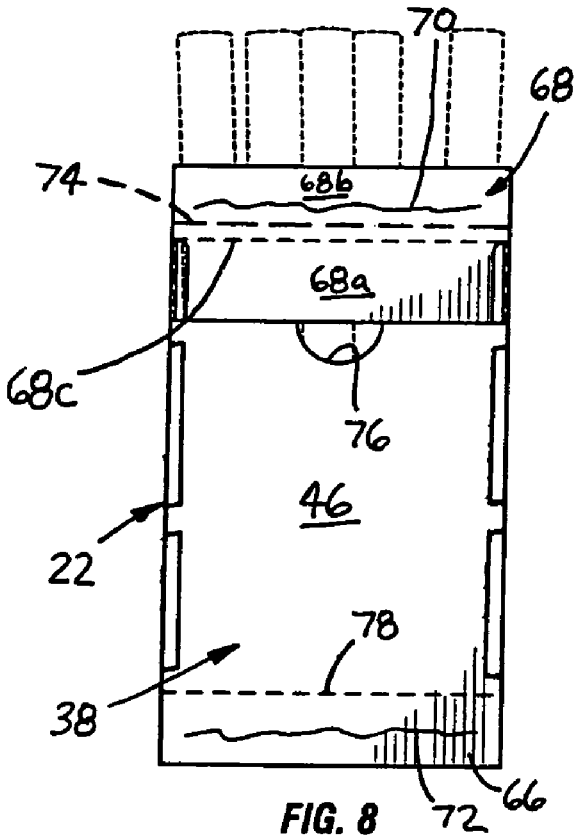
FIG. 8 is a front elevational view showing a double-folded portion of a reinforced top rail.
Figure 9:
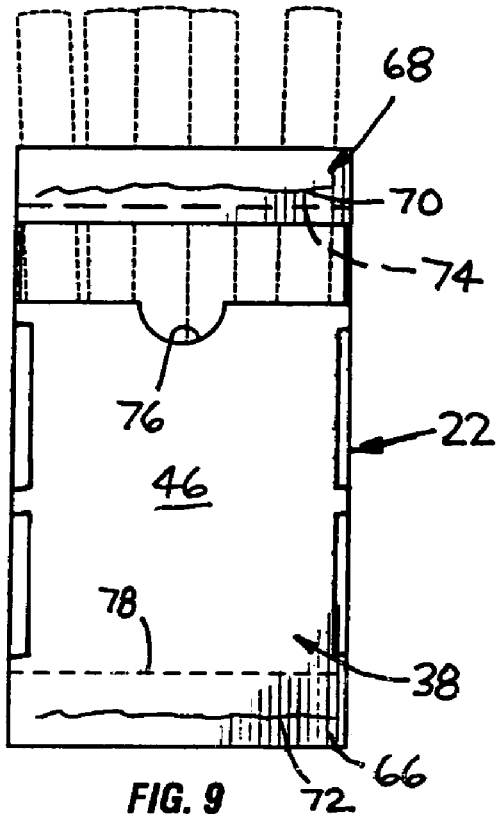
FIG. 9 is a front elevational view similar to FIG. 8 with the double-folded portion in an operative position.
Figure 10:
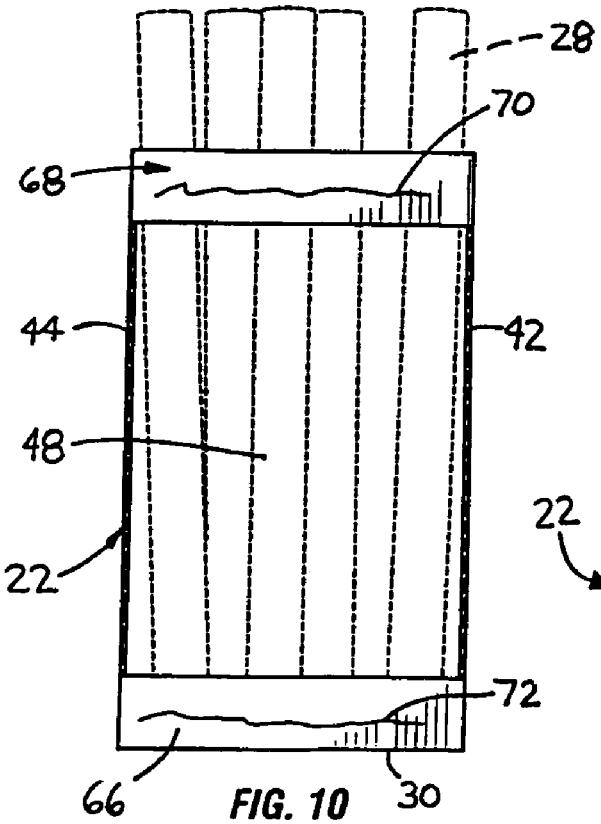
FIG. 10 is a front elevational view similar to FIG. 9 with the panel portion removed for displaying the products.
Figure 11:
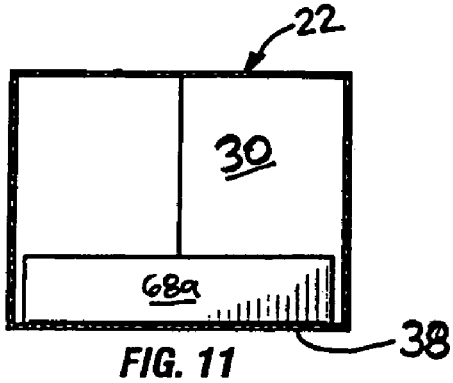
FIG. 11 is a top elevational view showing a double-folded portion of the reinforced top rail.
Figure 12:
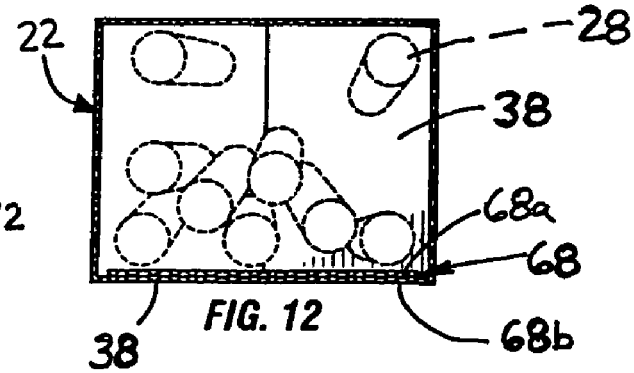
FIG. 12 is a top plan view similar to FIG. 11 showing the double-folded portion of the reinforced top rail in an operative position.

By comparing FIGS. 3 and 10, it will be appreciated that the removable panel portion 46 is formed in the front wall panel 38 at a point spaced above the bottom panel 30 of the display box 22 and is integral with and spans the side wall panels 42 and 44 at a plurality of discreet points 46*a-f* along front edges 42*a* and 44*a* thereof.

Referring once again to FIGS. 1 and 2, the shipping sleeve 24 is defined by a top panel 50 and a plurality of downwardly extending wall panels such as 52, 54 and 56 together forming a telescoping enclosure 58. The shipping sleeve 24 includes an open bottom 60 having a generally rectangular configuration defined by a bottom wall panel edge 62 disposed opposite the top panel 50. The wall panels include front and rear wall panels 52 and 64 and a pair of side wall panels 54 and 56 and the display box 22 can be positioned in the telescoping enclosure 58 (compare FIGS. 1 and 2). With this arrangement, it will be appreciated that the shipping sleeve 24 completely covers the open top 34 of the display box 22 to protect the elongated holiday gift wrap tubes 28 contained therewithin.

As previously mentioned, the product shipping and display carton 20 includes a removable fastener 26 such as carton tape or the like. The removable fastener 26 serves to secure the shipping sleeve 24 to the display box 22 during shipment but permits removal of the shipping sleeve 24 from the display box 22 after shipment to display the elongated holiday gift wrap tubes 28 disposed within the carrying and supporting enclosure 32 of the display box 22. In this connection, the removable fastener 26 may either be completely removed or slit in the case of carton tape to permit easy telescoping removal of the shipping sleeve 24 from the display box 22 when the product shipping and display carton 20 has arrived at its destination such as a retail store.

Referring now to FIGS. 8-12, the display box 22 is formed such that the front wall panel 38 comprises a bottom rail 66 and a reinforced top rail generally designated 68 for supporting the elongated holiday gift wrap tubes 28 vertically within the display box 22. It may be advantageous for the display box 22 and the shipping sleeve 24 to both be formed of a corrugated material due to the relatively inexpensive nature of such construction and the display box 22 may have printed product-related indicia 70 and graphics 72 to assist and attract a consumer at the point of sale. As will be appreciated, the printing of product-related indicia 70 and graphics 72 will attract and assist the consumer at the point of sale in making a decision as to purchase in a self-service manner.

Still referring to FIGS. 8-12, the reinforced top rail 68 of the front wall 38 may be formed of a reverse-folded portion 68*a* of the corrugated material to provide a double thickness thereof. In particular, the reverse-folded portion 68*a* may be folded inwardly and upwardly about foldline 68*c* to abut and be adhesively secured to the outwardly facing portion 68*b* of the reinforced top rail 68. With this arrangement, a wire 74 may be disposed between the double thickness provided by the reverse-folded portion 68*a* and the outwardly facing portion 68*b* of the reinforced top rail 68 to provide additional reinforcement for the top rail 68 of the front wall 38. By referring to FIG. 10, it can be seen that the elongated holiday gift wrap tubes 28 are fully supported within the carrying and supporting enclosure 32 by the bottom rail 66 and the reinforced top rail 68. The removable panel portion 46 can easily be removed by simply placing the hand in the cutout 76 and pulling outwardly to sever the discreet points 46*a-f* where it is initially integral with the front edges 42*a* and 44*a* of the side walls 42 and 44. As will also be appreciated, a line of perforation 78 may be formed between the removable panel portion 46 and the bottom rail 66 to further assist in removal of the panel portion 46.

When this has been accomplished, the elongated holiday gift wrap tubes 28 are almost completely visible through the viewing window 48 and can be removed either through the open top 34 or by raising them until the bottom end is disposed above the bottom rail 66, pulling them outwardly through the viewing window 48, and pulling them downwardly until the top end clears the reinforced top rail 68. As a result, the display box 22 can either be placed on the floor or on a shelf wherein the viewing window 48 is substantially at eye level providing significant versatility.

From the foregoing, it will be appreciated that the removable panel portion 46 of the display box 22 not only permits full visibility of the elongated holiday gift wrap tubes 28 but also provides rigidity for the display box 22 during shipment. Once the product shipping and display carton 20 is delivered to a store, and the shipping sleeve 22 is removed to prepare the display box 22 for placement in the store, the rigidity is no longer needed. However, the reinforced top rail 68 provides the necessary strength to support the weight of the elongated holiday gift wrap tubes 28 when the display box 22 is full or nearly full and encounters the stress caused by movement and removal of the tubes by customers.

With the present invention, it is no longer necessary to remove all of the elongated holiday gift wrap tubes from a shipping carton, physically transport and load the rolls onto the appropriate shelf in the self-service area of a store, and then provide necessary restraint hardware to hold the tubes in place. In addition, since the display box 22 is pre-printed with necessary information and desirable graphics, there is no need for store personnel to print out and apply signage to provide information at the display area. Of course, while described in connection with elongated holiday gift wrap tubes, the product shipping and display carton may find many others uses for it is necessary to ship products in bulk for display at the point of sale in a retail store.

While a preferred embodiment of the invention has been set forth in detail in the foregoing description, it will be appreciated that the invention is only to be limited by the scope of the appended claims.

What is claimed is:

1. A product shipping and display carton, comprising:

a display box defined by a bottom panel and an upwardly extending wall panel together forming a product carrying enclosure, the upwardly extending wall panel defined by a front wall, a rear wall, and a pair of side walls, the display box having a volume which is accessible through an open top which is opposite the bottom panel, the wall panel having a product-restraining rail and a removable panel portion below the product-restraining rail defining a product viewing window in the display box, the removable panel portion connected to the wall panel and disposed in the product viewing window at a location spaced from the product restraining rail, thereby defining a portion of the product viewing window disposed between the removable panel portion and the product restraining rail and extending entirely from one of the pair of side walls to the other, the product viewing window having a length that is generally smaller than a length of elongated, tubular shaped product to be contained within the display box, the length of the product viewing window being generally perpendicular to the product-restraining rail, the product-restraining rail positioned on the wall panel to hold elongated, tubular shaped product within the display box and to allow a customer to remove elongated, tubular shaped product from the display box either through the open top of the display box or by grasping the elongated, tubular shaped product through the product viewing window and at least:

a) displacing part of the elongated, tubular shaped product in a first direction outwardly through the product viewing window such that an opposing part of the elongated, tubular shaped product is disposed above the product-restraining rail and is moved inward within the display box, and b) displacing the elongated, tubular shaped product in a second direction until the opposing part of the elongated, tubular shaped product clears the product-restraining rail; and a shipping sleeve defined by a top panel and a downwardly extending wall panel together forming a telescoping enclosure, the shipping sleeve having an open bottom defined by a bottom wall panel edge opposite the top panel, the display box being positioned in the telescoping enclosure such that the open top and the upwardly extending wall panel are substantially covered by the shipping sleeve.

2. The product shipping and display carton of claim 1 wherein and the removable panel portion is formed in the front wall at a point spaced above the bottom panel.

3. The product shipping and display carton of claim 2 wherein the removable panel portion extends entirely from one of the side walls to the other of the side walls and is integrally associated with the side walls at a plurality of discrete points along front edges thereof.

4. The product shipping and display carton of claim 2 wherein the front wall comprises a second product-restraining rail integral with the bottom wall panel and the product-restraining rail integral with the side walls adjacent the top wall panel edge.

5. The product shipping and display carton of claim 1, wherein an entire length of the removable panel portion is less than the length of the product viewing window, the length of the removable panel portion being generally perpendicular to the product restraining rail.

6. A product shipping and display carton, comprising:

a display box defined by a bottom panel and a plurality of upwardly extending wall panels together forming a product carrying and supporting enclosure for elongated gift wrap tubes, the display box including an open top having a generally rectangular shape and being defined by a top wall panel edge disposed opposite the bottom panel, the wall panels including front and rear walls and a pair of side walls, and the front wall having a top rail for supporting elongated gift wrap tubes within the display box and a removable panel portion at a point spaced below the open top and the top rail in the display box to form a viewing window therewithin, at least a portion of the viewing window disposed between the removable panel portion and the top rail and extending entirely from one of the side walls to the other, the viewing window having a length that is generally smaller than a length of elongated gift wrap tubes to be contained within the display box, the length of the viewing window being generally perpendicular to the top wall panel edge and the top rail;

the top rail positioned on the front wall panel to hold elongated gift wrap tubes within the display box and to allow a customer to remove elongated gift wrap tubes from the display box either through the open top of the display box or by grasping the elongated gift wrap tubes through the product viewing window and at least:

a) displacing part of the elongated gift wrap tubes outwardly through the product viewing window such that an opposing part of the elongated, tubular shaped product is disposed above the product-restraining rail and is moved inward within the display box, and b) displacing the elongated gift wrap tubes in a second direction that is generally away from the top rail until the opposing part of the elongated gift wrap tubes clear the top rail;

a shipping sleeve defined by a top panel and a plurality of downwardly extending wall panels together forming a telescoping enclosure, the shipping sleeve including an open bottom having a generally rectangular configuration defined by a bottom wall panel edge disposed opposite the top panel, the wall panels including front and rear walls and a pair of side walls and the display box being adapted to be positioned within the telescoping enclosure;

the shipping sleeve covering the open top of the display box and covering a majority of each of the plurality of upwardly extending wall panels to protect elongated gift wrap tubes to be contained therewithin.

7. The product shipping and display carton of claim 6 wherein the removable panel portion is formed as a portion of the front wall at a point spaced above the bottom panel of the display box.

8. The product shipping and display carton of claim 6 wherein the removable panel portion is integral with and spans the distance between the side walls at a plurality of discrete points along front edges thereof.

9. The product shipping and display carton of claim 6 wherein the front wall further comprises a bottom rail for supporting elongated gift wrap tubes within the display box.

10. The product shipping and display carton of claim 6, wherein an entire length of the removable panel portion is less than the length of the viewing window, the length of the removable panel portion being generally perpendicular to the top rail.

11. A product display box, comprising:

a bottom panel and an upwardly extending wall panel together forming a product carrying enclosure, the upwardly extending wall panel including a front wall, a rear wall, and a pair of side walls, the wall panel having an open top, a top product-restraining rail and a removable panel portion below the top product-restraining rail defining a product viewing window in the display box, at least a portion of the product viewing window disposed between the top product-restraining rail and the removable panel portion and extending entirely from one of the side walls to the other, the product viewing window having a length that is generally smaller than a length of elongated, tubular shaped product to be contained within the display box, the length of the product viewing window being generally perpendicular to the top product-restraining rail, the top product-restraining rail positioned on the wall panel to hold elongated, tubular shaped product within the display box and to allow a customer to remove elongated, tubular shaped product from the display box either through the open top of the wall panel or by grasping the elongated, tubular shaped product through the product viewing window and at least:

a) displacing part of the elongated, tubular shaped product outwardly through the product viewing window such that an opposing part of the elongated, tubular shaped product is disposed above the product-restraining rail and is moved inward within the display box, and b) displacing the elongated, tubular shaped product in a second direction that is angled to a face of the top product-restraining rail until the opposing part of the elongated, tubular shaped product clears the top product-restraining rail.

12. The product display box of claim 11 wherein the front wall further comprises a bottom rail for supporting elongated gift wrap tubes within the display box.

13. The product display box of claim 11 further comprising an open top defined by a top wall panel edge opposite the bottom panel.

14. The product display box of claim 11, wherein an entire length of the removable panel portion is less than the length of the product viewing window, the length of the removable panel portion being generally perpendicular to the product-restraining rail.

15. A product display box, comprising:

a bottom panel and a plurality of upwardly extending wall panels together forming a carrying and supporting enclosure for elongated gift wrap tubes, the wall panels including front and rear wall panels and a pair of side wall panels, the wall panels defining an open top and the front wall panel having a top rail for supporting elongated gift wrap tubes within the display box and a removable panel portion below the top rail to form a viewing window;

the removable panel portion being formed in the front wall panel at a point spaced above the bottom panel of the display box and being integral with and spanning the side wall panels at a plurality of discrete points along front edges thereof;

the removable panel portion spaced below the top rail such that at least a portion of the viewing window that spans the side wall panels is disposed between the top rail and the removable panel portion, the viewing window having a length that is generally smaller than a length of elongated gift wrap tubes to be contained within the display box, the length of the viewing window being generally perpendicular to the top rail;

the top rail positioned on the front wall panel to hold elongated gift wrap tubes within the display box and to allow a customer to remove elongated gift wrap tubes from the display box either through the open top defined by the wall panels or by grasping the elongated gift wrap tubes through the product viewing window and at least:

a) displacing a first end of the elongated gift wrap tubes outwardly through the product viewing window such that an opposing second end of an elongated gift wrap tube is disposed above the product-restraining rail and is moved inward within the display box, and then b) displacing the elongated gift wrap tubes in a second direction that is generally away from the top rail until the second end of the elongated gift wrap tubes clears the top rail, the second end opposed to the first end.

16. The product shipping and display carton of claim 15 wherein the front wall further comprises a bottom rail for supporting elongated gift wrap tubes within the display box.

17. The product shipping and display carton of claim 16 further comprising displacing the elongated gift wrap tubes in a direction that is generally opposite the second direction and is generally toward the top rail until the first end of the elongated gift wrap tubes clears the bottom rail, before displacing the first end of the elongated gift wrap tubes outwardly through the product viewing window.

18. The product shipping and display carton of claim 15 wherein the display box includes an open top having a generally rectangular configuration defined by a top wall panel edge disposed opposite the bottom panel.

19. The product display box of claim 15, wherein an entire length of the removable panel portion is less than the length of the viewing window, the length of the removable panel portion being generally perpendicular to the top rail.

20. A product shipping and display carton including a display box and a shipping sleeve, the display box defined by a bottom panel and an upwardly extending wall panel together forming a product carrying enclosure, the wall panel having an open top, a first product-restraining rail and a second product-restraining rail, the shipping sleeve defined by a top panel and a downwardly extending wall panel together forming a telescoping enclosure, the shipping sleeve having an open bottom defined by a bottom wall panel edge opposite the top panel, the display box being positioned in said telescoping enclosure such that said open top and said upwardly extending wall panel are substantially covered by the shipping sleeve; the shipping sleeve adapted for removal from the display box after shipment to display the elongated, tubular shaped products disposed within the product carrying enclosure of the display box, the product shipping and display carton comprising:

a removable panel portion between the first product-restraining rail and the second product-restraining rail;

the first product-restraining rail, the second product-restraining rail, and the removable panel portion defining a product viewing window in the display box, the removable panel portion spaced below the first product restraining rail such that a portion of the viewing window that extends entirely between a pair of side wall panels of the upwardly extending wall panel is disposed between the removable panel portion and the first product restraining rail, the product viewing window having a window length and a window width that are generally smaller than a length of elongated, tubular shaped products to be contained within the display box, the window length of the product viewing window being generally perpendicular to the first product-restraining rail and the window width of the product viewing window being generally parallel to the first product-restraining rail, the first product-restraining rail positioned on the front wall panel to hold elongated gift wrap tubes within the display box and to allow a customer to remove elongated gift wrap tubes from the display box by at least:

a) displacing the elongated gift wrap tubes in a first direction that is generally toward the first product-restraining rail and away from the second product-restraining rail until a first end of the elongated gift wrap tubes clears the second product-restraining rail, b) displacing the first end of the elongated gift wrap tubes outwardly through the product viewing window such that a second end of the elongated gift wrap tubes is disposed above the first product-restraining rail and is moved inward within the display box, and c) displacing the elongated gift wrap tubes in a third direction that is generally away from the first product-restraining rail until the second end of the elongated gift wrap tubes clears the first product-restraining rail, the second end opposed to the first end;

the elongated gift wrap tubes also being removable through the open top of the wall panel.

21. The product shipping and display carton of claim 20, wherein the display box includes an open top having a generally rectangular configuration defined by a top wall panel edge disposed opposite the bottom panel.

22. The product shipping and display carton of claim 20, wherein an entire length of the removable panel portion is less than the length of the viewing window, the length of the removable panel portion being generally perpendicular to the first product- restraining rail.

23. A display box having an open top, comprising:

a removable panel portion between a first product-restraining rail and a second product-restraining rail;

the first product-restraining rail, the second product-restraining rail, and the removable panel portion defining a product viewing window in the display box, the removable panel portion spaced below the first product restraining rail such that a portion of the viewing window that extends entirely between a pair of side wall panels of the upwardly extending wall panel is disposed between the removable panel portion and the first product restraining rail, the product viewing window having a window length and a window width that are generally smaller than a length of elongated gift wrap tubes to be contained within the display box, the window length of the product viewing window being generally perpendicular to the first product-restraining rail and the window width of the product viewing window being generally parallel to the first product-restraining rail, the first product-restraining rail positioned on a wall panel to hold elongated gift wrap tubes within the display box and to allow a customer to remove elongated gift wrap tubes from the display box either through the open top or by:

a) displacing the elongated gift wrap tubes in a first direction that is generally toward the first product-restraining rail and away from the second product-restraining rail until a first end of the elongated gift wrap tubes clears the second product-restraining rail, b) displacing the first end of the elongated gift wrap tubes outwardly through the product viewing window such that a second end of the elongated gift wrap tubes is disposed above the product-restraining rail and is moved inward within the display box, and c) displacing the elongated gift wrap tubes in a third direction that is generally away from the first product-restraining rail until the second end of the elongated gift wrap tubes clears the first product-restraining rail, the second end opposed to the first end.

24. The display box of claim 23, comprising a shipping sleeve defined by a top panel and a plurality of downwardly extending wall panels together forming a telescoping enclosure, the shipping sleeve including an open bottom having a generally rectangular configuration defined by a bottom wall panel edge disposed opposite the top panel, the wall panels including front and rear walls and a pair of side walls and the display box being adapted to be positioned within the telescoping enclosure;

the shipping sleeve covering a majority of the display box to protect elongated gift wrap tubes to be contained therewithin.

25. The display box of claim 23, wherein an entire length of the removable panel portion is less than the length of the product viewing window, the length of the removable panel portion being generally perpendicular to the first product-restraining rail.

* * * * *